US011299928B2

(12) United States Patent
Sprague

(10) Patent No.: US 11,299,928 B2
(45) Date of Patent: Apr. 12, 2022

(54) DOOR STILE AND DOORWAY JAMB SYSTEM AND METHOD

(71) Applicant: Gary Sprague, Visalia, CA (US)

(72) Inventor: Gary Sprague, Visalia, CA (US)

(73) Assignee: FRAMELESS HARDWARE COMPANY LLC, Wilmington, DE (US)

( * ) Notice: Subject to any disclaimer, the term of this patent is extended or adjusted under 35 U.S.C. 154(b) by 1 day.

(21) Appl. No.: 16/896,479

(22) Filed: Jun. 9, 2020

(65) Prior Publication Data

US 2021/0381305 A1 Dec. 9, 2021

(51) Int. Cl.

| | |
|---|---|
| ***E06B 3/70*** | (2006.01) |
| ***E06B 3/02*** | (2006.01) |
| ***E06B 3/54*** | (2006.01) |

(52) U.S. Cl.

CPC ..... *E06B 3/7001* (2013.01); *E06B 3/02* (2013.01); *E06B 3/5454* (2013.01); *E06B 3/7015* (2013.01)

(58) Field of Classification Search

CPC ..... E06B 3/02; E06B 3/5454; E06B 3/585; E06B 3/5857; E06B 3/5864; E06B 3/7001; E06B 3/7015

See application file for complete search history.

(56) References Cited

U.S. PATENT DOCUMENTS

| | | | | |
|---|---|---|---|---|
| 4,763,453 | A * | 8/1988 | Horgan, Jr. | E04C 2/384 24/524 |
| 6,434,905 | B1 * | 8/2002 | Sprague | E06B 3/02 49/501 |
| 7,963,077 | B2 * | 6/2011 | Lin | E06B 3/72 52/204.597 |
| 9,777,484 | B2 * | 10/2017 | Header | E04F 11/1853 |
| 9,816,276 | B2 * | 11/2017 | Noble | E04F 11/1812 |
| 10,718,117 | B2 * | 7/2020 | Noble | E04F 11/1853 |
| 2015/0240851 | A1 * | 8/2015 | Giacometti | E04F 11/1812 403/374.3 |

FOREIGN PATENT DOCUMENTS

| | | | | |
|---|---|---|---|---|
| WO | WO-2016024299 A1 * | 2/2016 | | F16B 2/12 |

* cited by examiner

*Primary Examiner* — Christine T Cajilig
(74) *Attorney, Agent, or Firm* — Cohen IP Law Group, PC; Michael N. Cohen

(57) ABSTRACT

A stile system to support a door or other types of panels is provided. The doors and/or panels may include frameless glass panes. The stile system may include a longitudinal channel into which the side of the door may be received and secured. The system may include a clamping assembly that may provide clamping forces onto the opposing lateral surfaces of the door within the longitudinal channel to secure it therein. The clamping assembly may be controlled by a controlling assembly in combination with the housing to provide inward forces to the clamping members to secure the panel. The stile system also includes a unitizing gasket configured to hold the elements of the clamping assembly in place during the system's assembly and use.

21 Claims, 8 Drawing Sheets

DOOR STILE AND DOORWAY JAMB SYSTEM AND METHOD

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to doors, including frameless glass door stile systems and methods.

BACKGROUND

Frameless heavy glass doors and panels for use with commercial and/or residential buildings typically utilize stile systems to provide support to the doors or panels while in use. The stile systems are typically designed to extend along one or more vertical edges of the doors or panels (e.g., along the side edges), and often, may extend along both vertical sides of a door to improve resistance to air and water infiltration, and to increase the rigidity of the door to resists live loads, e.g., wind pressure and/or forced entry. Hardening of the glass edges to protect against impact breakage is another benefit of such a stile system.

However, the stile systems are often bulky and do not maintain the structures' "frameless" appearance.

In addition, the doors or panels are often permanently secured within the stile systems such that if the doors or panels become broken or otherwise need replacement, the stile systems must also be replaced. This adds cost and additional labor.

Also, in some instances, the doors or panels are removably configured with the stile systems, thereby avoiding this problem. However, current removable stile systems are difficult to assemble, do not provide a uniform attachment pressure to the doors or panels, and are generally bulky.

Accordingly, there is a need for a removable stile system for use with frameless glass panel doors or panels that is easy to install, that provides uniform, controlled, attachment pressure to the doors or panels, and that are streamlined in appearance.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

As used herein, unless used otherwise, the following terms and abbreviations have the following meanings:

Outboard means towards the outside, and in the case of a stile system and associated panel, towards the area outside the stile system and panel. Unless otherwise stated, this will typically be depicted in the FIGS as the portion of the system to the left of the system's median plane.

Inboard means towards the inside, and in the case of a stile system and associated panel, towards the area outside the stile system and panel. Unless otherwise stated, this will typically be depicted in the FIGS as the portion of the system to the right of the system's median plane.

Lateral means towards the side, and in the case of a stile system and associated panel, facing away from the middle (the median plane) of the stile or panel.

Medial means towards the middle, and in the case of a stile system and associated panel, facing towards the middle (the median plane) of the stile or panel.

In general, the system according to exemplary embodiments hereof provides a glass door stile system and its method of use for providing support to a glass door. The door stile system includes a longitudinal channel within which the glass door is removably mounted and secured. It is understood that the door stile system also may be used for other types of structures such as glass panes and/or other types of panels. It is also understood that the system may be used to provide support to structures comprising materials other than glass.

Referring now to FIGS. 1-7, the system 10 according to exemplary embodiments hereof will be described in further detail. In some embodiments, the door stile system 10 may be used in conjunction with a door rail system such as the door rail system described in U.S. patent application Ser. No. 16/817,439, filed on Mar. 12, 2020, the entire contents of which are hereby fully incorporated herein by reference for all purposes.

Figure 1:
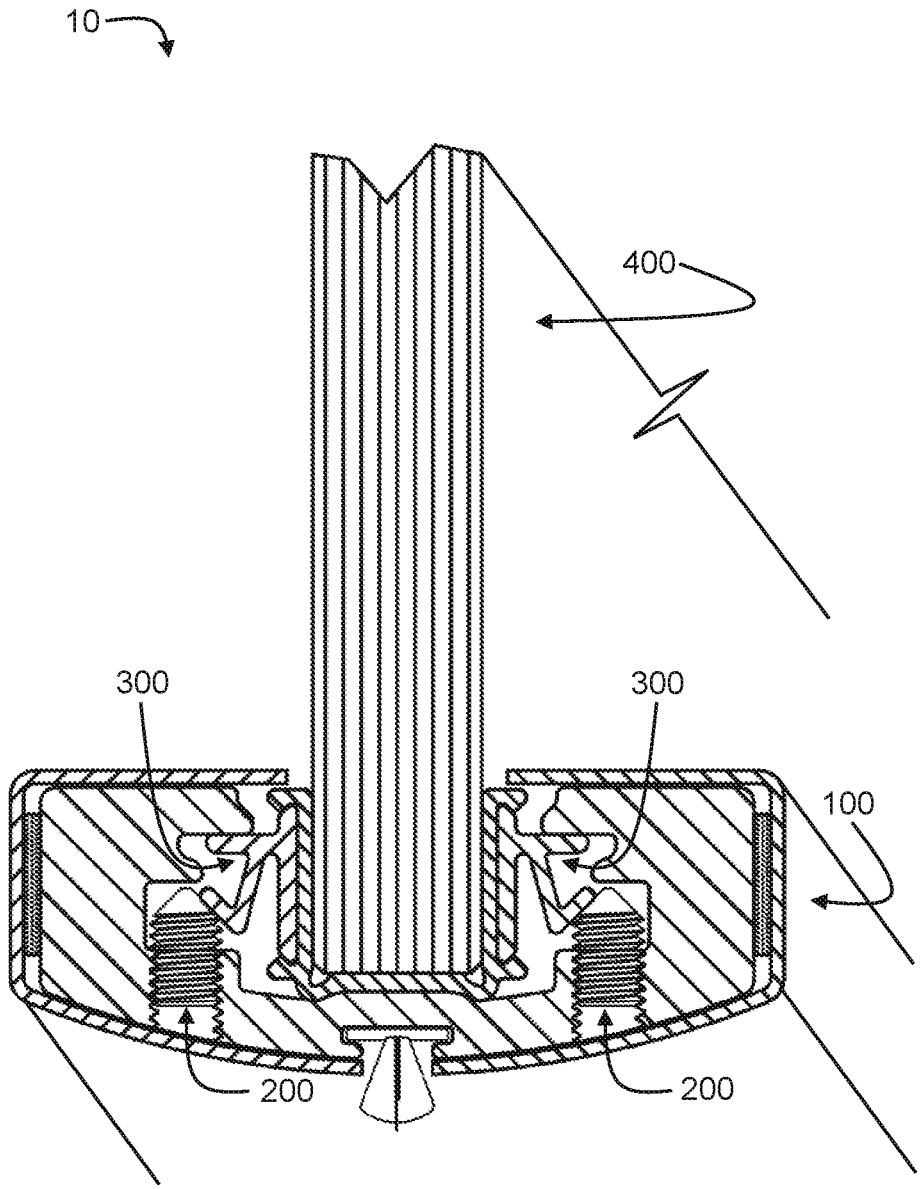
FIG. 1 shows aspects of a door stile system according to exemplary embodiments hereof.

In one exemplary embodiment hereof as shown in FIG. 1, the system 10 includes a housing 100, a control assembly 200 and a clamping assembly 300. The system 10 may include other elements and components as necessary to fulfill its functionalities.

In general, the system 10 is adapted to secure and support the side portion of a panel 400 (e.g., a side edge of a glass door or pane). The control assembly 200 and the clamping assembly 300 are housed within the housing 100, and the control assembly 200 in combination with the housing 100 control the inward clamping motions of the clamping assembly 300 as it engages with and supports the panel 400. In some embodiments, the control assembly 200 and the clamping assembly 300 generally extend along the longitudinal length of the housing 100, while in other embodiments, the control assembly 200 and/or the clamping assembly 300 extend along portions of the longitudinal length of the housing 100 as required to secure the panel 400.

Housing Assembly

Figure 2:
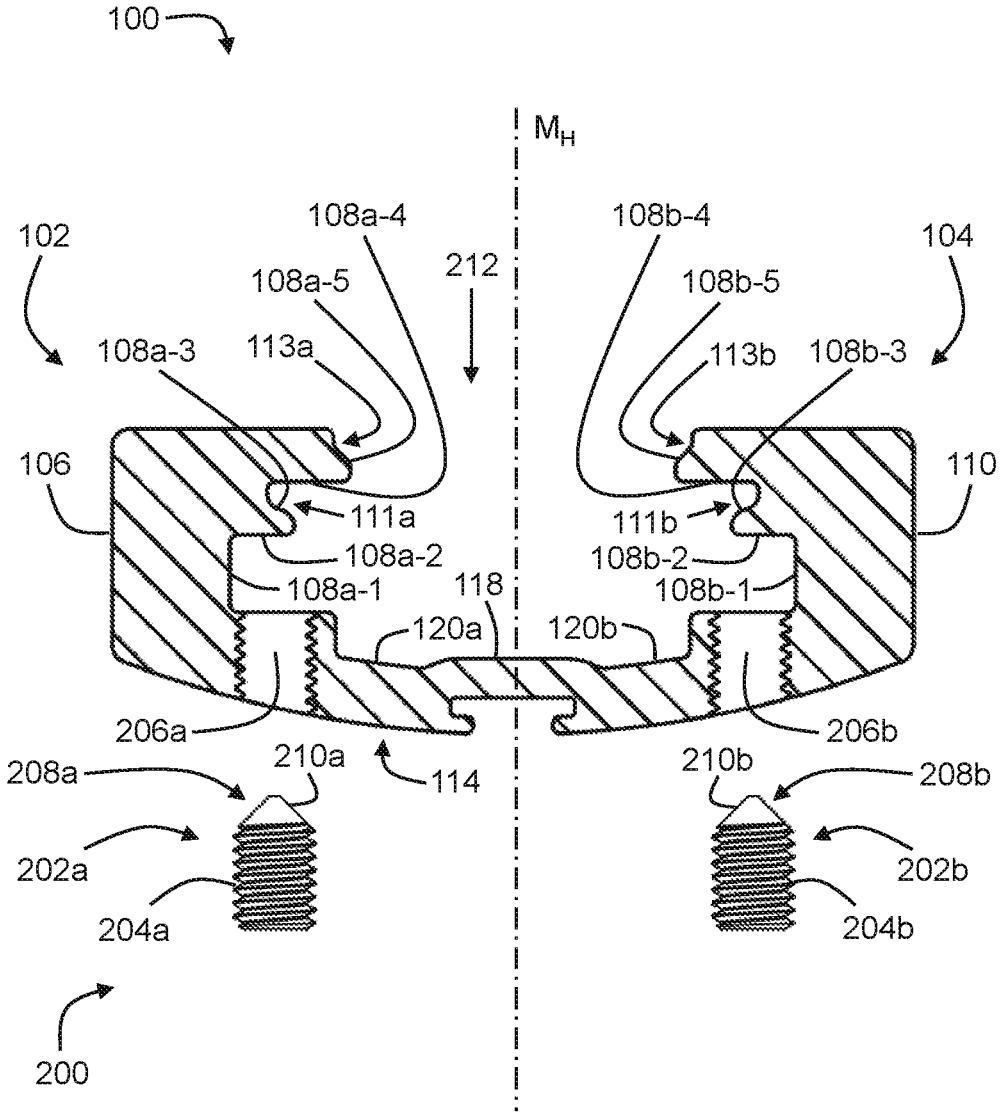
FIG. 2 shows aspects of a housing assembly and a control assembly according to exemplary embodiments hereof.

In one exemplary embodiment as shown in FIG. 2, the housing 100 includes an outboard portion 102 and an inboard portion 104. The housing 100 may comprise aluminum or other materials and may be formed using an extrusion process or other processes. The outboard portion 102 includes an outboard lateral surface 106 and a plurality of separate and distinct inner channel surfaces **108*a*-1, 108*a*-2, 108*a*-3, . . . 108*a*-*n* (individually and collectively 108*a*). The inboard portion 104 includes an inboard lateral surface 110 and a plurality of separate and distinct inner channel surfaces 108***b*-1, 108*b*-2, 108*b*-3, . . . 108*b*-*n* (individually and collectively 108*b*). The outboard portion's inner channel surfaces 108*a* and the inboard portion's inner channel surfaces 108*b* define the housing's inner channel 112 within which the panel 400 may be received and secured. The outboard portion 102 and inboard portion 104 are joined by a base support 114 that extends laterally between the portions 102, 104 thereby defining the bottom 116 of the inner channel 112. The bottom 116 may include a raised middle portion 118 (e.g., centered at the median plane $M_H$) defining an outboard lower cavity 120*a* and an inboard lower cavity 120*b* to the left and right, respectively, of the raised middle portion 118. The purpose and benefits of these elements 118, 120*a*, 120*b* will be described in other sections.

In one exemplary embodiment hereof, the outboard portion's inner channel surfaces 108*a* and the inboard portion's inner channel surfaces 108*b* generally mirror one another in regard to positioning, orientation, shape and size across the inner channel 112. However, this may not be necessary. As will be described in other sections, each inner channel surface 108*a*, 108*b* has a distinct and purposeful functionality in supporting and guiding the clamping assembly 300.

In one embodiment, a first outboard inner channel surface 108*a*-1 and a first inboard inner channel surface 108*b*-1 extend upward and generally upright from the bottom 116 of the channel 112. These surfaces 108*a*-1, 108*b*-1 may be generally vertical. A second outboard inner channel surface 108*a*-2 and a second inboard inner channel surface 108*b*-2 extend inward from the top of the first surfaces 108*a*-1, 108*b*-1, respectively, at inward inclined angles (towards the median plane of the channel 112). In some embodiments, the second outboard inner channel surface 108*a*-2 and a second inboard inner channel surface 108*b*-2 extend perpendicularly inward (i.e., horizontally) with respect to the median plane of the channel 112. The inner channel surfaces 108*a*-2, 108*b*-2 also may be referred to as clamp screw stop surfaces 108*a*-2, 108*b*-2. A third outboard inner channel surface 108*a*-3 and a third inboard inner channel surface 108*b*-3 extend from the inner portion of the second surfaces 108*a*-2, 108*b*-2, respectively, upward and generally away from the median plane of the channel 112. A fourth outboard inner channel surface 108*a*-4 and a fourth inboard inner channel surface 108*b*-4 extend inward from the top portion of the third surfaces 108*a*-3, 108*b*-3, respectively, at inward inclined angles (towards the median plane of the channel 112). In some embodiments, the fourth outboard inner channel surface 108*a*-4 and a fourth inboard inner channel surface 108*b*-4 extend perpendicularly inward (i.e., horizontally) with respect to the median plane of the channel 112. The inner channel surfaces 108*a*-4, 108*b*-4 also may be referred to as channel guide surfaces 108*a*-4, 108*b*-4. A fifth outboard inner channel surface 108*a*-5 and a fifth inboard inner channel surface 108*b*-5 extend from the inner portion of the fourth surfaces 108*a*-4, 108*b*-4, respectively, upward and generally away from the median plane of the channel 112.

It is understood that the housing 100 may include additional inner channel surfaces as required, and that all of the inner channel surfaces 108*a*, 108*b* described above may not be necessary for all applications.

In some embodiments, the third outboard inner channel surface 108*a*-3 in combination with the fourth outboard inner channel surface 108*a*-4 forms the side notch 111*a*, and the third inboard inner channel surface 108*b*-3 in combination with the fourth inboard inner channel surface 108*b*-4 forms the side notch 111*b*. In addition, the fifth outboard inner channel surface 108*a*-5 forms the outboard side notch 113*a* and the fifth inboard inner channel surface 108*b*-5 forms the inboard side notch 113*b*.

The purpose and functionality of each separate and distinct inner channel surface 108*a*, 108*b* and the side notches 111*a*, 111*b*, 113*a*, 113*b* will be described in detail in other sections.

Control Assembly

In one exemplary embodiment hereof as shown in FIG. 2, the control assembly 200 includes one or more control mechanisms 202. In some embodiments, the one or more control mechanisms 202 include one or more wedges.

In some embodiments, the one or more control mechanisms 202 include one or more clamp screws 204 configured within corresponding clamp screw openings 206 within the housing 100. In some embodiments, the one or more clamp screws 204 include an outboard clamp screw 204*a* adapted to be received within an outboard clamp screw opening 206*a*, and an inboard clamp screw 204*b* adapted to be received within an inboard clamp screw opening 206*b*. As shown, the outboard clamp screw opening 206*a* may be positioned on the outboard portion of the bottom 114 of the housing 100 (to the left of the housing's median plane $M_H$), and the inboard clamp screw opening 206*b* may be positioned on the inboard bottom 114 of the housing 100 (to the right of the housing's median plane $M_H$). Each clamp screw opening 206*a*, 206*b* may preferably extend through the housing 100 from outside the housing 100 into an inner volume within the housing 100. For example, in some embodiments, the clamp screw openings 206*a*, 206*b* may each extend through the housing 100 from outside the housing 100 to the inner channel 112 within the housing 100. In this way, when received into the clamp screw openings 206*a*, 206*b*, the front portions 208*a*, 208*b* of the clamp screws 204*a*, 204*b*, respectively, also may extend into the inner channel 112 within the housing 100. In some embodiments, the front portions 208*a*, 208*b* of the clamp screws 204*a*, 204*b*, respectively, also may extend into other inner volumes of the housing 100 (e.g., inner volumes adjacent to the inner channel 112).

In some embodiments, the clamp screw openings 206*a*, 206*b* extend generally parallel to the housing's median plane $M_H$ and generally perpendicular to the housing's transverse plane. Accordingly, the clamp screws 204*a*, 204*b* within each opening 206*a*, 206*b*, respectively, also may extend in these directions. However, it is understood that the clamp screw openings 206*a*, 206*b* and the corresponding clamp screws 204*a*, 204*b* may extend in other directions as required by the system 10. For example, in some embodiments, the clamp screw openings 206*a*, 206*b* and the corresponding clamp screws 204*a*, 204*b* may extend at offset angles with respect to the median plane $M_H$.

In some embodiments, the clamp screw openings 206*a*, 206*b* include inner screw threads and the corresponding clamp screws 204*a*, 204*b* include corresponding outer screw threads such that the clamp screws 204*a*, 204*b* may be screwed into the openings 206*a*, 206*b*, respectively, and held therein by the engaging threads. In other embodiments, the clamp screws 204*a*, 204*b* may be received into the clamp screw openings 206*a*, 206*b* and held therein using other methods such as pressure fit, notches and detents, adhesive, welding, other securing methods and any combination thereof.

In some embodiments, the front portions 208*a*, 208*b* (e.g., the tips) of the clamp screws 204*a*, 204*b*, respectively, include wedges. In some embodiments, the front portions

208*a*, 208*b* of the clamp screws 204*a*, 204*b*, respectively, include wedges in the form of cone tips 210*a*, 210*b*, respectively. That is, in some embodiments, the front portions 208*a*, 208*b* of the clamp screws 204*a*, 204*b*, respectively, are wedge-shaped. As will be described in other sections, the cone tips 210*a*, 210*b* may engage with and cause to move elements of the clamping assembly 300. In some embodiments, the back portions 212*a*, 212*b* of the clamp screws 204*a*, 204*b*, respectively, are fashioned with screw heads such that a tool (e.g., a hex wrench or screw driver) may be used to rotate the clamp screws 204*a*, 204*b* into and out of the clamp screw openings 206*a*, 206*b*. For example, the back portions 212*a*, 212*b* may be fashioned as hex, slotted, Phillips, Pozidrive, square recess or Roberson, Torx, other types of screw heads and any combination thereof.

Clamping Assembly

Figure 3:
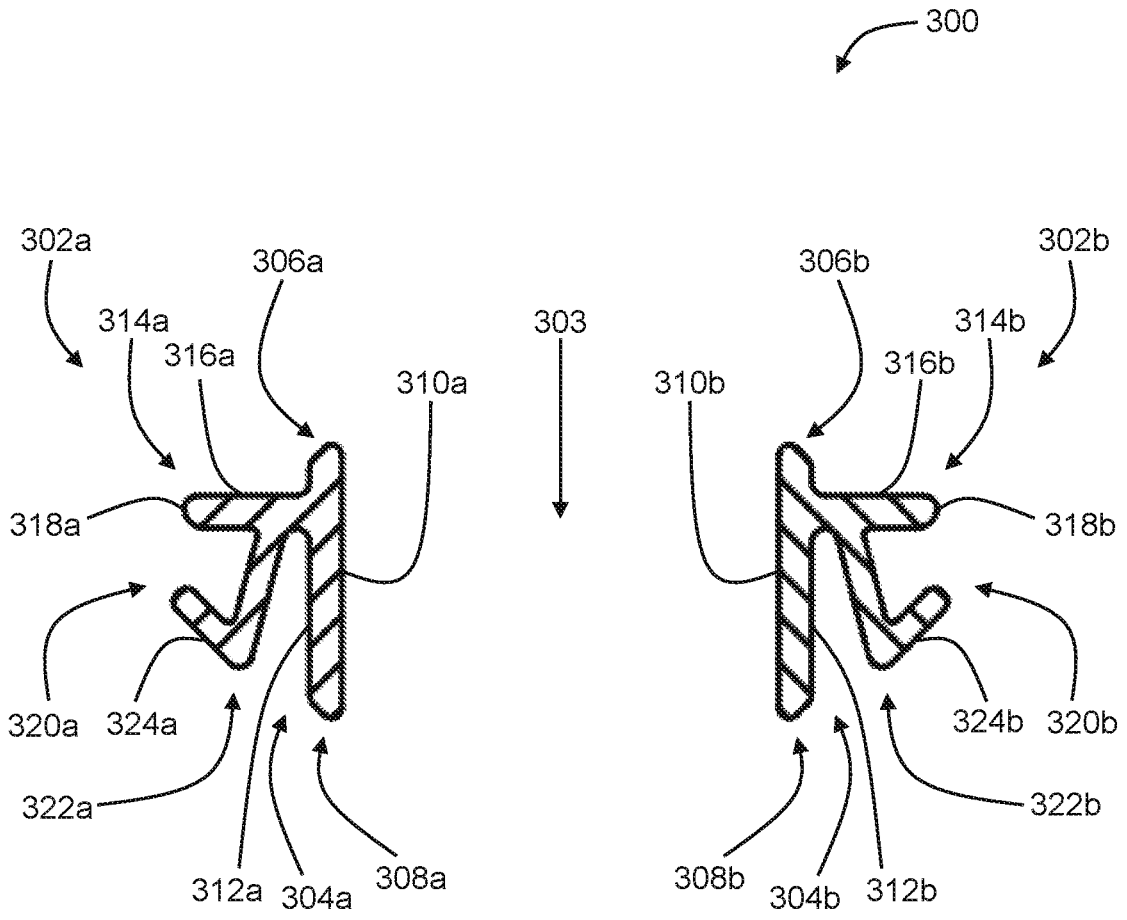
FIGS. 3-4 show aspects of a clamping assembly according to exemplary embodiments hereof.

In one exemplary embodiment hereof as shown in FIG. 3, the clamping assembly 300 includes an outboard clamping member 302*a* and an inboard clamping member 302*b* positioned face-to-face opposite one another and defining a clamping channel 303 therebetween the two within which the panel 400 may be received and secured. The clamping members 302*a*, 302*b* may comprise aluminum or other materials and may be formed using an extrusion process or other processes. As will be described in other sections, when the clamping assembly 300 is configured within the housing 100, the clamping channel 303 may generally align with the housing's inner channel 112.

The outboard clamping member 302*a* includes a front wall 304*a* with a top portion 306*a*, a bottom portion 308*a*, a front surface 310*a* (also referred to as a clamping surface) generally extending between the top 306*a* and the bottom 308*a* on the medial side, and a back surface 312*a* generally extending from the top 306*a* to the bottom 308*a* on the lateral side. An upper leg 314*a* extends outward from the back surface 312*a* and includes an upper clamp guide surface 316*a* and an outer end portion 318*a*. The upper clamp guide surface 316*a* may be generally horizontal, but other angles also may be used. A lower leg 320*a* extends from the upper leg 314*a* (or alternatively, from the back surface 312*a* of the front wall 304*a*) downward and at an outward angle. The lower portion 322*a* of the lower leg 320*a* includes a force translation surface 324*a* extending from the lower portion 322*a* upward and outward. As will be described in other sections, an upward force directed to the force translation surface 324*a* (e.g., provided by the control assembly 200) may be translated into a sideways force applied to the outboard clamping member 302*a* directed to the right in FIG. 3 (i.e., towards the median plane $M_H$ when the clamping member 302*a* is configured within the housing 100). In this way, the clamping member 302*a* may be caused to move towards the median plane $M_H$ such that the clamping surface 310*a* may engage a panel 400 (within the channel 112) and secure it thereby.

While the clamping member 302*a* has been described and shown as having a body comprising the discreet elements of a front wall 306*a*, an upper leg 314*a* and a lower leg 320*a*, the clamping member 302*a* may include any architecture or form that may generally include a clamping surface 310*a*, an upper clamp guide surface 316*a*, and a force translation surface 324*a*. For example, the front wall 306*a*, the upper leg 314*a* and the lower leg 320*a* may be combined (e.g., by removing and/or by filling in at least some of the free space between the structures 306*a*, 314*a*, 320*a*) to form a somewhat solid clamping member 302*a* body with a front surface 310*a*, an upper surface 316*a* and a lower surface 324*a*, and that may generally provide the same or similar functionality as the clamping member 302*a* as described above with relation to FIG. 3. It is understood that the clamping member 302*a* may include any form or shape that may generally include a front clamping surface 310*a*, an upper clamp guide surface 316*a* and a lower force translation surface 324*a*, and that that the scope of the clamping member 302*a* and the system 10 is not limited in any way by the general shape or form of the clamping member 302*a*.

In some embodiments, the inboard clamping member 302*b* includes a mirrored image of the outboard clamping member 302*a* and comprises a front wall 304*a* with a top portion 306*a*, a bottom portion 308*a*, a front surface 310*a* (also referred to as a clamping surface) and a back surface 312*a*, an upper leg 314*a* with an upper clamp guide surface 316*a* and an outer end portion 318*a*, and a lower leg 320*a* with a lower portion 322*a* and a force translation surface 324*a*. It is understood that any and/or all of the details and aspects described above regarding the outboard clamping member 302*a* may also pertain to the inboard clamping member 304*b*, and that for the sake of brevity, these details need not be described again here with regards to the inboard clamping member 302*b*.

In one exemplary embodiment hereof, the outboard clamping member 302*a* and the inboard clamping member 302*b* are positioned face-to-face opposite one another with each member's clamping surface 310*a*, 310*b*, respectively, facing one another across the clamping channel 303. In this way, the clamping members 302*a*, 302*b* may generally mirror one another in regard to positioning, orientation, shape and size as shown.

Figure 4:
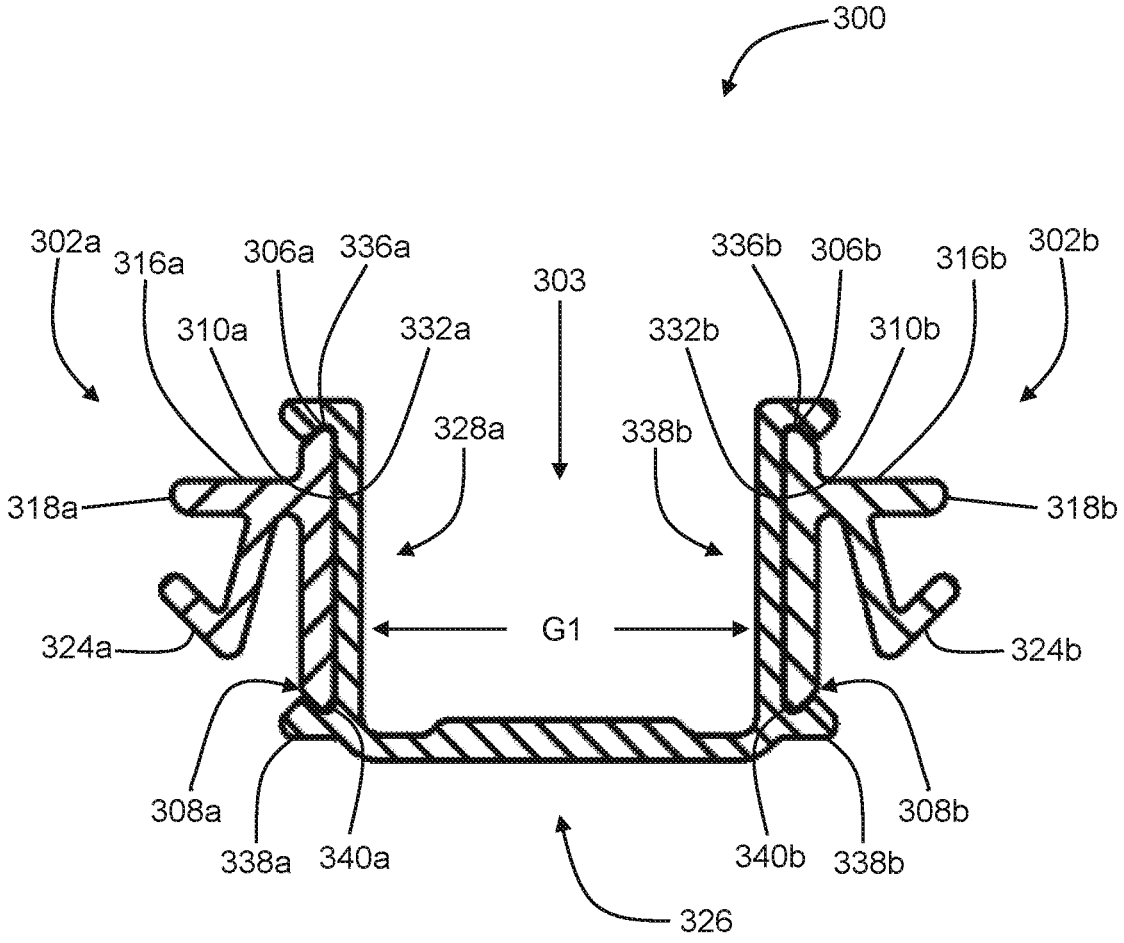

In one exemplary embodiment hereof as shown in FIG. 4, the clamping assembly 300 includes a clamping gasket member 326 configured with the outboard and inboard clamping members 302*a*, 302*b*. In some embodiments, the clamping gasket member 326 may include a clamping gasket as described in U.S. patent application Ser. No. 16/848,581 filed on Apr. 14, 2020, the entire contents of which are hereby fully incorporated herein by reference for all purposes.

In some embodiments, the gasket member 326 is a single piece with a generally U-shaped and/or V-shaped cross-section. Accordingly, the gasket member 326 may include an outboard portion 328*a*, an inboard portion 328*b* and a bottom 330 connecting the outboard and inboard portions 328*a*, 328*b* thereby defining the U-shaped and/or V-shaped member 326. In other embodiments, the gasket's outboard portion 328*a* and inboard portion 328*b* may be formed separately and combined to form the overall gasket member 326. The gasket member 326 may comprise silicon or other suitable material(s).

In one exemplary embodiment hereof, the outboard clamping member's clamping surface 310*a* is configured with the lateral surface 332*a* of the gasket's outboard portion 328*a*, and the inboard clamping member's medial surface 310*b* is configured with the lateral surface 332*b* of the gasket's inboard portion 328*b*. It is preferable that the footprint of surface 310*a* (e.g., the height) generally match that of surface 332*a*, and that the footprint of surface 310*b* (e.g., the height) generally match that of surface 332*b* as shown in FIG. 4. However, this may not be necessary.

In some embodiments, the gasket's outboard portion 328*a* includes an upper tab 334*a* that forms an upper notch 336*a* configured with an upper portion of the gasket's lateral surface 332*a*, and a lower tab 338*a* that forms a lower notch 340*a* configured with a lower portion of the gasket's lateral surface 332*a*. The upper notch 336*a* is adapted to receive the top portion 306*a* of the outboard clamping member's front wall 304*a*, and the lower notch 340*a* is adapted to receive the bottom portion 308*a* of the outboard clamping member's front wall 304*a*. In this way, the upper notch 336*a* and the lower notch 340*a* may bookend and hold secure therebetween the outboard clamping member's front wall 304*a*, thereby configuring the outboard clamping member 302*a* with the outboard portion 328*a* of the gasket 326.

Similarly, the gasket's inboard portion 328*b* includes an upper tab 334*b* that forms an upper notch 336*b* configured with an upper portion of the gasket's lateral surface 332*b*, and a lower tab 338*b* that forms a lower notch 340*b* configured with a lower portion of the gasket's lateral surface 332*b*. The upper notch 336*b* is adapted to receive the top portion 306*b* of the inboard clamping member's front wall 304*b*, and the lower notch 340*b* is adapted to receive the bottom portion 308*b* of the inboard clamping member's front wall 304*b*. In this way, the upper notch 336*b* and the lower notch 340*b* may bookend and hold secure therebetween the inboard clamping member's front wall 304*b*, thereby configuring the inboard clamping member 302*b* with the inboard portion 328*b* of the gasket 326.

Accordingly, the outboard and inboard clamping members 302*a*, 302*b* may thusly be configured with the gasket 326, thereby eliminating any costly adhesive bonding processes. The attachment also may provide adequate shear strength thereby minimizing the risk of the gasket 326 being inadvertently removed by and/or during the clamping process to the panel 400. Other types of attachment mechanisms also may be used to configure the gasket 326 with the clamping members 302*a*, 302*b*, such as, without limitation, corresponding slots and tabs, adhesive, double-sided tape, other types of attachment mechanisms and any combination thereof.

In any event, it is preferable that the surfaces 328*a*, 328*b* be held generally tight and flush against the respective surfaces 310*a*, 310*b*. In this way the outboard clamping member 302*a*, the inboard clamping member 302*b* and the gasket member 326 are held together as a unit to generally form the clamping assembly 300 as shown in FIG. 4. Given this, the gasket member 326 may be referred to as a unitizing gasket 326.

Figure 5:
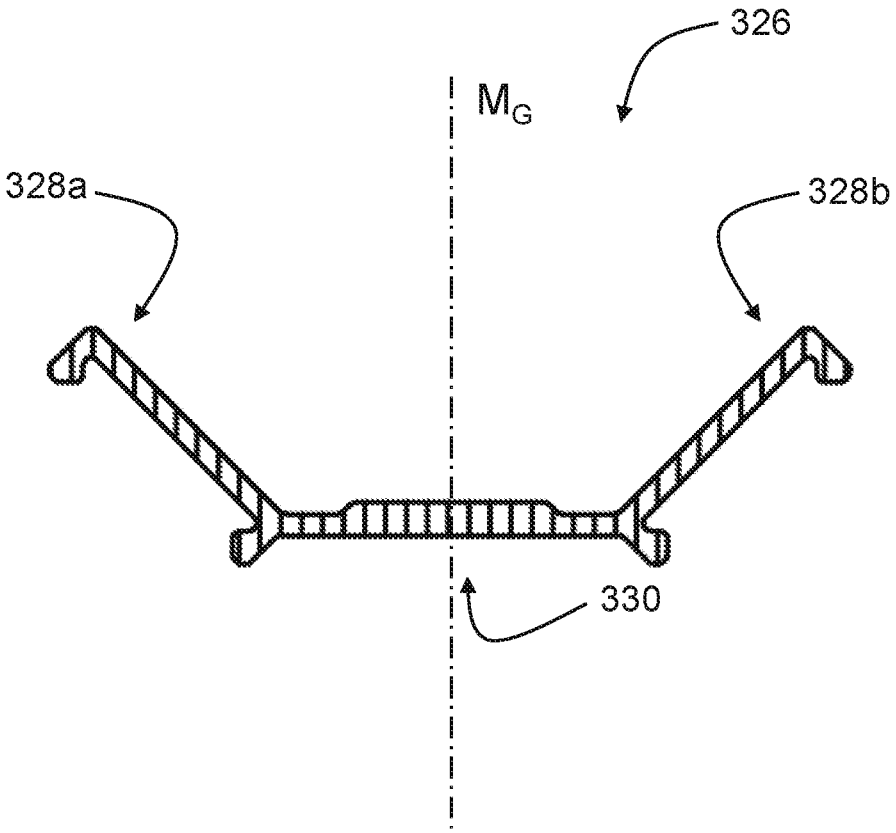
FIG. 5 shows aspects of a gasket according to exemplary embodiments hereof.

In some embodiments, the gasket member 326, in its at rest and unflexed state, holds the outboard and the inboard clamping members 302*a*, 302*b* apart and separated by a gap G1 (e.g., the gap between opposing gasket clamping surfaces). In some embodiments as shown in FIG. 5, the gasket member 326 may include a pre-assembly outward bias such that the gasket's outboard portion 328*a* and inboard portion 328*b* may each extend outward from the gasket's bottom 330, each at an acute angle with respect to the median plane $M_G$ of the gasket 326. This outward bias may increase the outward force applied by the gasket portions 328*a*, 328*b* to the clamping members 302*a*, 302*b*, respectively. This may be beneficial during assembly of the stile system 10 onto a horizontally oriented glass panel 400 by counteracting the forces of gravity on the clamping members 302*a*, 302*b* thereby holding them open for the insertion of the panel 400. This may also hold the clamping assembly 200 within the housing 100 when the system 10 is preassembled and shipped to its ultimate location.

As will be described in other sections, when the clamping members 302*a*, 302*b* are moved towards one another in a clamping motion to secure a panel 400 within the housing 100, the bottom portion 330 of the gasket member 326 may be adapted to compress (e.g., kink or bend inward on itself) to accommodate the clamping motion and to allow the gap G1 to decrease accordingly.

In some embodiments, the preferred wall thickness range of the unitizing gasket 326 is between 0.040" and 0.050" as this may mitigate the loss of clamping range due to compression of the gasket material, and reduce the amount of compression set (i.e., loss of resilient outward force that reduces the thickness of the wall after compressive forces are removed). However, it is understood that other gasket wall thickness ranges may be used, and that the scope of the system 10 is not limited in any way by the thickness of the gasket's walls. For example, the gasket wall thickness may range from 0.010" to 0.10". In addition, gasket wall thicknesses greater than 0.10" and/or less than 0.010" may be used in some applications.

The System (Combined Assemblies)

Figure 6:
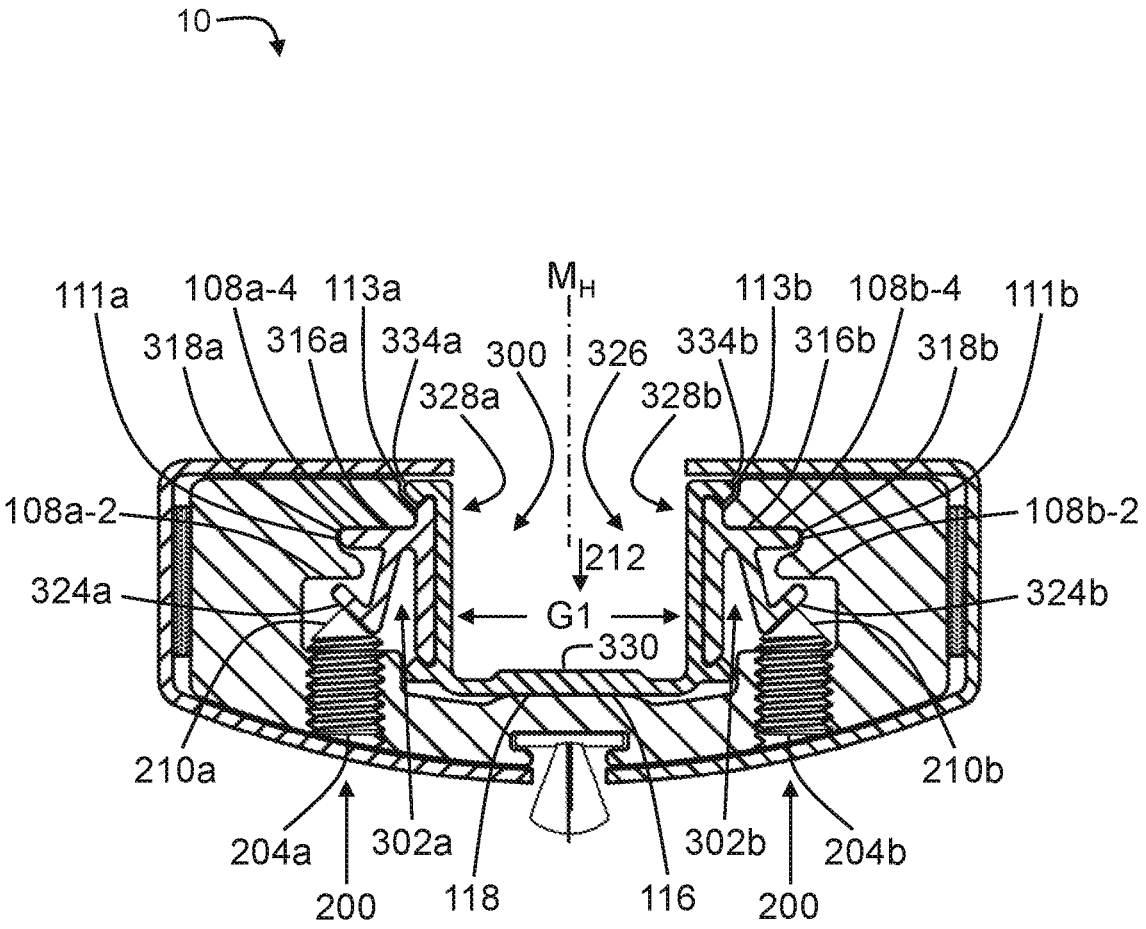
FIGS. 6-8 show aspects of a door stile system according to exemplary embodiments hereof.

In one exemplary embodiment hereof as shown in FIG. 6, the control assembly 200 is configured within the housing assembly 100 as described above with reference to FIG. 2, and the clamping assembly 300 is configured generally within the channel 112 and adapted to engage with the control assembly 200.

In this arrangement, the following may be preferable:

1) The outer portion of the gasket's outboard upper tab 334*a* engages with housing's outboard side notch 113*a* and is held thereby.
2) The outer portion of the gasket's inboard upper tab 334*b* engages with inboard side notch 113*b* and is held thereby.
3) The outer end portion 318*a* of the outboard clamping member's upper leg 314*a* engages with the housing's outboard side notch 111*a* and is held thereby.
4) The outer end portion 318*b* of the inboard clamping member's upper leg 314*b* engages with the housing's inboard side notch 111*b* and is held thereby.
5) The gasket's bottom portion 330 generally rests on the raised middle portion 118 on the bottom 116 of the inner channel 112.

Note that not all of the configurations described in 1)-5) above may be required at all times, and that it may be adequate that one or more of the configurations be present for any given application. In this way, the clamping assembly 200 may be configured within the housing 100 and held therein in its generally unclamped configuration. Also note that the outward bias of the gasket's outboard and inboard portions 328*a*, 328*b* may provide outward forces to the clamping members 302*a*, 302*b* to further support the clamping assembly 200 in the configurations described above.

In one exemplary embodiment hereof, the clamping screws 204*a*, 204*b* may be driven into the housing 100 until the cone tips 210*a*, 210*b* engage with the force translation surfaces 324*a*, 324*b*, respectively, of the clamping members 302*a*, 302*b*. It may be preferable that the angle of each cone tip 210*a*, 210*b* correspond with the angle of each corresponding force translational surface 324*a*, 324*b*, respectively, so that the interface between the cone tips 210*a*, 210*b* and the corresponding force translational surface 324*a*, 324*b*, respectively, are flush. This is shown in FIG. 6.

In some embodiments, the angle of each force translation surface 324*a*, 324*b* and of the corresponding cone tips 210*a*, 210*b* may be at an acute angle with respect to the median plane $M_H$. In other embodiments, these angles may range from about 20° to about 70°, and preferably about 45°. It is understood that other angles also may be used for various applications. In addition, it may be preferable that the force translational surfaces 324*a*, 324*b* be at mirrored angles with one another with respect to the median plane $M_H$ so that the forces applied to the surfaces 324*a*, 324*b* by the cone tips 210*a*, 210*b* are equivalent given equivalent upward cone tip

210*a*, 210*b* travel. Note also that the characteristics of the force translation surfaces 324*a*, 324*b* may be adjusted (e.g., the positioning, thickness, angle, etc.) to adjust the interface between the surfaces 324*a*, 324*b* and the cone tips 210*a*, 210*b*, and to regulate the forces applied to the surfaces 324*a*, 324*b* by the clamping screws 204*a*, 204*b*.

To cause the clamping members 302*a*, 302*b* to each move inward in a clamping motion (e.g., to secure a panel 400 positioned within the channel 112), the following procedure may be followed:

1) The clamping screws 204*a*, 204*b* are each driven further into the housing 100 such that the cone tips 210*a*, 210*b* apply upward forces to the force translation surfaces 324*a*, 324*b*, respectively, perpendicular (normal) to the interface between the tips 210*a*, 210*b* and the surfaces 324*a*, 324*b*, respectively. Note that the interface between the cone tips 210*a*, 210*b* and the force translation surfaces 324*a*, 324*b*, respectively, also may be referred to as force interfaces.
2) The normal forces applied to the force translation surfaces 324*a*, 324*b* are translated into vertical upward forces and horizontal inward forces applied to the clamping members 302*a*, 302*b*. Precision control of force when used with insulating glass can be achieved by varying the wall thickness of the clamping members 302*a*, 302*b* (e.g., the wall thickness of the force translation surfaces 324*a*, 324*b*). Thinning these walls will permit more deflection under load, reducing overall force output, while thickening the walls will reduce deflection transferring more clamping force.
3) The channel guide surfaces 108*a*-4, 108*b*-4 provide stops to the upward forces by abutting against the upper clamp guide surfaces 316*a*, 316*b*, respectively.
4) The inward forces cause the clamping members 302*a*, 302*b* to each move horizontally towards the median plane $M_H$ of the housing in a clamping motion. During this motion, the clamp guide surfaces 316*a*, 316*b* slide along the channel guide surfaces 108*a*-4, 108*b*-4, respectively.

Figure 7:
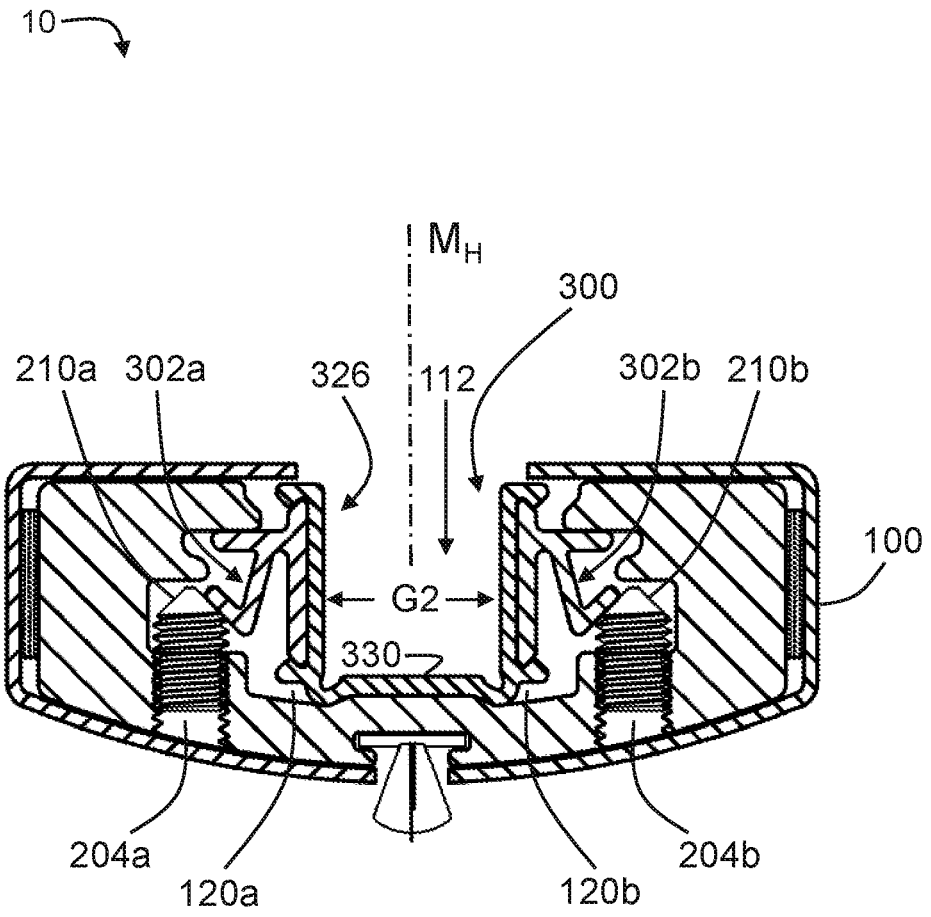

The result of this is shown in FIG. 7.

It is understood that the above described procedure is meant for demonstration and that not all of the steps described may be necessary. It is also understood that other steps not described may be performed. Also, the order of the steps performed also may differ from that described.

It may be preferable that the clamping screws 204*a*, 204*b* are driven an equivalent or similar distance into the housing 100 so that the respective forces applied to the clamping members 302*a*, 302*b* are generally equal to one another causing a generally equivalent clamping movement of each clamping member 302*a*, 302*b*. However, in some applications this may not be necessary or desired.

In some embodiments, the second outboard inner channel surface 108*a*-2 and the second inboard inner channel surface 108*b*-2 provide stops to the clamping screws 204*a*, 204*b*, respectively. That is, as the clamping members 302*a*, 302*b* are deflected inward towards the median plane $M_H$ due to the upward movement of the screws 204*a*, 204*b*, the surfaces 108*a*-2, 108*b*-2 limit the upward travel of each screw 204*a*, 204*b* by blocking the tips 210*a*, 210*b* at a desired height. This may prevent damage to the clamping members 302*a*, 302*b* potentially caused by over torqueing of the clamp screws 204*a*, 204*b*. This also may limit the inward travel distance of the clamping members 302*a*, 302*b* and regulate the amount of force applied to the panel 400 by each member 302*a*, 302*b*.

In some embodiments as shown in FIGS. 6 and 7, the unitizing gasket 326 holds the clamping members 302*a*, 302*b* in position during the clamping motion during which the gap G1 (FIG. 6) may be reduced (as the members 302*a*, 302*b* approach one another). The reduced gap G2 is shown in FIG. 7.

In addition, the bottom portion 330 of the gasket member 326 may be adapted to shorten (e.g., kink, bend and/or compress) to accommodate the clamping motion and to allow the gap G1 to decrease (e.g., to decrease to a smaller gap G2). In this way, the unitizing gasket 312 may continue to hold the clamping members 302*a*, 302*b* in position while its bottom portion 330 may shorten. In some embodiments, the outboard portion of the gasket's bottom portion 330 may bend downward into the space provided by the housing's outboard lower cavity 120*a*, and the inboard portion of the gasket's bottom portion 330 may bend downward into the space provided by the housing's inboard lower cavity 120*b*. In some embodiments, the outboard and inboard portions of the gasket's bottom portion 330 may include thicknesses that are less than the middle portion of the gasket's bottom portion 330 so that the outboard and inboard portions may more easily fold downward. The thicker middle portion also may provide additional support and cushion to a panel 400 configured within the channel 112.

In some embodiments, the bottom of the panel 400 may be inserted into the clamping assembly's channel 303 and the threaded clamping screws 204*a*, 204*b* may be rotated to cause the inward clamping motions of the clamping members 302*a*, 302*b*. This in turn causes the clamping members 302*a*, 302*b* to clamp and thereby hold and support the panel 400 within the system 10 (as shown in FIG. 1). The horizontal clamping motion minimizes any change in the panel's penetration depth in the channel 303 (112) throughout the panel clamping range, leaving the panel height relatively unchanged during the clamping process. This also may maintain parallelism of the panel stile with respect to the plane of the panel 400 and may aid in equalizing the force distribution along the panel 400 imposed by the gasket 312 contact surfaces.

Figure 8:
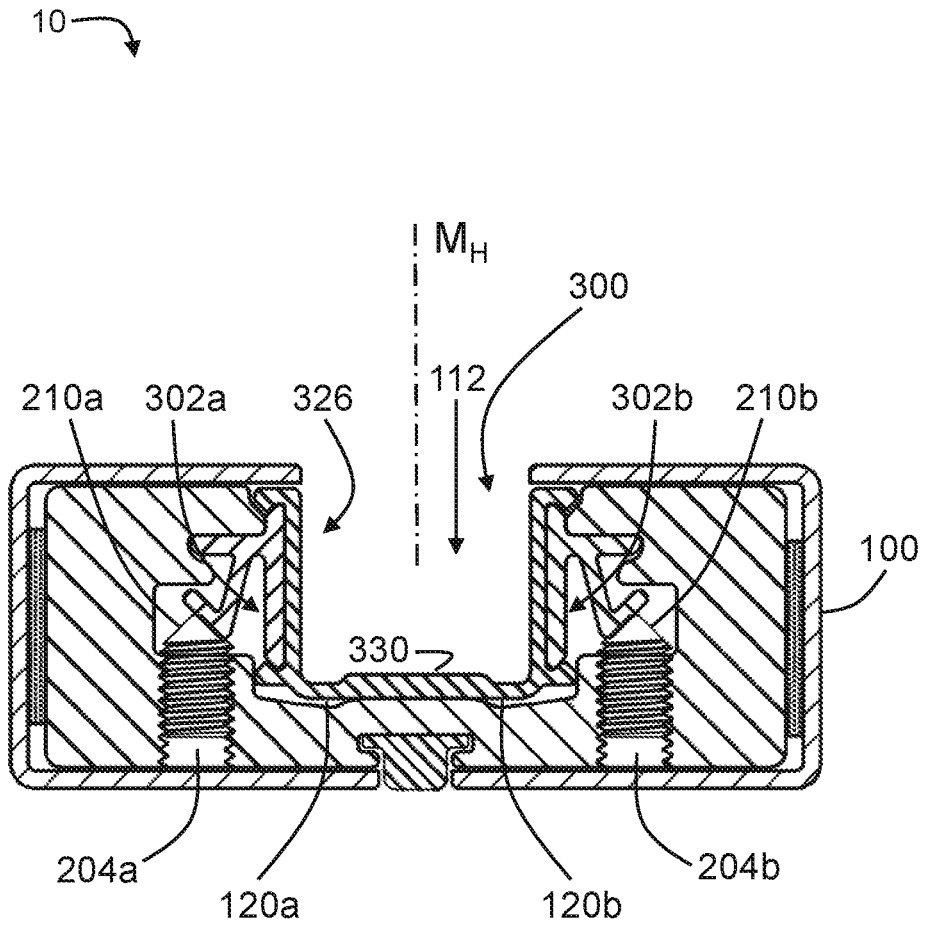

In some exemplary embodiments hereof as shown in FIG. 8, the housing 100 may include a generally rectangular cross-section (not counting the channel 112). In some embodiments, this form may be a preferred implementation for a doorway jamb. In some embodiments, this implementation also may include a filler strip opposite the channel 212.

Benefits of the System

The benefits of the system 10 are multifold and include, without limitation:

First, the system 10 provides a weather seal at the vertical edges of glass panels 400 and doorway jambs used with heavy glass entrances.

Second, the narrow profile of the system 10 maintains a frameless glass look for the glass panels 400 it is used to secure.

For example, when used to support glass panels 400 with thicknesses of ⅜", ½", and/or 9⁄16", the housing 100 may be about 26⁄32" wide by about 2 1⁄16" deep. When used to support glass panels 400 with thicknesses of ¾" and/or 13⁄16", the housing 100 may be about 26⁄32" wide by 2 5⁄16" deep. And when used to support glass panels 400 with a thickness of 1", the housing 100 may be about 1⅛" wide by about 2½" deep.

It is understood that the example dimensions of the housing 100 shown above are meant for demonstration and that the housing 100 and the overall system 10 may be dimensioned as necessary to support any type of panel 400 of any thickness. For example, the system 10 can be configured for greater I.G. thicknesses when future building codes may require improved energy efficiencies. The system 10 also may be configured for lesser I.G. thicknesses as required. Accordingly, it is understood that the scope of the system 10 is not limited in any way by its dimensions or the thicknesses of the panel(s) that it may be adapted to support.

Third, the system 10 grips the vertical edges of a glass panel 400 without the need for adhesive tape, adhesives or other types of additional attachment mechanisms.

Fourth, no special tools are required during installation. The system only requires one tee handle hex wrench to operate the control assembly 200 (e.g., to rotate the clamp screws 204).

Fifth, the control assembly 200 (e.g., the clamp screws 204) is accessible at a single face opposite the glass panel 400 secured therein. This allows for unrestricted turning of the hex drive wrench during installation.

Sixth, the system 10 is compatible with a broad range of glass panel thicknesses and compositions.

Seventh, the system 10 may ship as a complete unit, ready for installation without assembly.

Eighth, the force translation surfaces 324 may be adjusted (e.g., thickness, position, angle, etc.) to accommodate clamping force sensitive insulating glass units.

Ninth, the clamp screw stop surfaces 108 prevent damage to the clamping members 302 potentially caused by over torqueing of the clamp screws 204.

Tenth, the clamp screw stop surfaces 108 enable the regulation of clamping forces to the panel 400 held by the system 10.

Eleventh, the system 10 controls the clamping force a desired limit, when used in conjunction with insulating glass to preserve integrity of the perimeter seals that create the interior cavity between the glass lites, thereby preventing gases from escaping, and water from entering.

It is understood that the benefits shown above are meant for demonstration and that other benefits of the system 10 may also exist. Those of ordinary skill in the art will appreciate and understand, upon reading this description, that embodiments hereof may provide different and/or other advantages, and that not all embodiments or implementations need have all advantages.

It is also understood that any aspect or detail of any embodiment described herein or otherwise may be combined with any other aspect or detail of any other embodiment to form an additional embodiment that is also within the scope of the system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A system for releasably securing a panel, the system comprising:

a housing;

a first clamping member including a first clamping surface;

a second clamping member including a second clamping surface opposing the first clamping surface forming a channel therebetween within the housing and adapted to receive the panel;

a gasket having a first portion configured with the first clamping surface, a second portion configured with the second clamping surface, the first portion and/or the second portion including an outward bias, the gasket adapted to provide an interface between the first and second clamping surfaces and the panel to be secured;

a first control mechanism adapted to apply a first control force in a first force direction to the first clamping member;

a first guide surface adapted to guide movement of the first clamping member in a first guide direction;

a second control mechanism adapted to apply a second control force in a second force direction to the second clamping member;

a second guide surface adapted to guide movement of the second clamping member in a second guide direction;

wherein the first control force causes the first clamping member to move generally in the first guide direction, and the second control force causes the second clamping member to move generally in the second guide direction.

2. The system of claim 1 wherein the first control force causes the first clamping member to move generally towards the second clamping member, and the second control force causes the second clamping member to move generally towards the first clamping member.

3. The system of claim 1 wherein the first guide direction is generally perpendicular to the first force direction, and/or the second guide direction is generally perpendicular to the second force direction.

4. The system of claim 1 wherein the first clamping member includes a first force translation surface and the first control mechanism is adapted to apply the first control force to the first force translation surface, and/or the second clamping member includes a second force translation surface and the second control mechanism is adapted to apply the second control force to the second force translation surface.

5. The system of claim 4 wherein the first force translation surface is oriented at an acute angle with respect to the first force direction, and/or the second force translation surface is oriented at an acute angle with respect to the second force direction.

6. The system of claim 1 wherein the first control mechanism includes a first wedge and/or the second control mechanism includes a second wedge.

7. The system of claim 1 wherein the first control mechanism includes a first clamp screw within a first clamp screw opening and/or the second control mechanism includes a second clamp screw within a second clamp screw opening.

8. The system of claim 7 wherein the first clamp screw includes a first wedge-shaped tip and/or the second clamp screw includes a second wedge-shaped tip.

9. The system of claim 1 further comprising a first stop surface adapted to limit movement of the first control mechanism in the first force direction, and/or a second stop surface adapted to limit movement of the second control mechanism in the second force direction.

10. The system of claim 1 wherein the housing includes a bottom defining a channel bottom, and the first and/or second control mechanisms are accessible opposite the channel bottom.

11. The system of claim 1 wherein the gasket is adapted to hold the first and second clamping members in an opposing position.

12. The system of claim 1 wherein the gasket further comprises a bottom portion configured between the first portion and the second portion, wherein the bottom portion is adapted to compress and/or bend into a lower cavity within the housing when the first clamping mechanism moves generally perpendicular to a first restricted direction and/or when the second clamping mechanism moves generally perpendicular to a second restricted direction.

13. The system of claim 1 wherein the system includes a door stile, a door rail, and/or a doorway jamb.

14. A system for releasably securing a panel, the system comprising:

a housing;

a first clamping member including a first force translation surface and a first clamping surface including a first clamping surface top end;

a second clamping member including a second force translation surface and a second clamping surface including a second clamping surface top end, the second clamping member opposing the first clamping member forming a channel therebetween within the housing and adapted to receive the panel;

a gasket having a first portion configured with the first clamping surface and a first upper gripping member configured to releasably secure the first clamping surface top end thereto, and a second portion configured with the second clamping surface and a second upper gripping member configured to releasably secure the second clamping surface top end thereto, the gasket adapted to provide an interface between the first and second clamping surfaces and the panel to be secured;

a first control mechanism adapted to apply a first control force in a first force direction to the first force translation surface;

a second control mechanism adapted to apply a second control force in a second force direction to the second force translation surface;

wherein the first control force causes the first clamping member to move generally perpendicular to the first force direction, and the second control force causes the second clamping member to move generally perpendicular to the second force direction.

15. The system of claim 14 further comprising a first guide surface adapted to guide movement of the first clamping member in a first guide direction, and/or a second guide surface adapted to guide movement of the second clamping member in a second guide direction.

16. The system of claim 14 wherein the first force translation surface is oriented at an acute angle with respect to the first force direction, and/or the second force translation surface is oriented at an acute angle with respect to the second force direction.

17. The system of claim 14 wherein the first control mechanism includes a first wedge and/or the second control mechanism includes a second wedge.

18. A system for releasably securing a panel, the system comprising:

a housing;

a first clamping member including a first clamping surface and a first clamping surface top end;

a second clamping member including a second clamping surface and a second clamping surface top end, the second clamping surface opposing the first clamping surface forming a channel therebetween within the housing and adapted to receive the panel;

a gasket having a first portion configured with the first clamping surface and a first upper gripping member configured to releasably secure the first clamping surface top end thereto, and a second portion configured with the second clamping surface and a second upper gripping member configured to releasably secure the second clamping surface top end thereto, the gasket adapted to provide an interface between the first and second clamping surfaces and the panel to be secured;

a first control mechanism adapted to apply a first control force in a first force direction to the first clamping member;

a first guide surface adapted to guide movement of the first clamping member in a first guide direction;

a second control mechanism adapted to apply a second control force in a second force direction to the second clamping member;

a second guide surface adapted to guide movement of the second clamping member in a second guide direction;

wherein the first control force causes the first clamping member to move generally in the first guide direction, and the second control force causes the second clamping member to move generally in the second guide direction.

19. The system of claim 18 wherein the first clamping surface includes a first clamping surface bottom end, and the second clamping surface includes a second clamping surface bottom end, and the gasket includes a first lower gripping member configured to releasably secure the first clamping surface bottom end thereto, and a second lower gripping member configured to releasably secure the second clamping surface bottom end thereto.

20. The system of claim 14 wherein the first clamping surface includes a first clamping surface bottom end, and the second clamping surface includes a second clamping surface bottom end, and the gasket includes a first lower gripping member configured to releasably secure the first clamping surface bottom end thereto, and a second lower gripping member configured to releasably secure the second clamping surface bottom end thereto.

21. A system for releasably securing a panel, the system comprising:

a housing;

a first clamping member including a first clamping surface;

a second clamping member including a second clamping surface opposing the first clamping surface forming a channel therebetween within the housing and adapted to receive the panel;

a gasket having a first portion configured with the first clamping surface, a second portion configured with the second clamping surface, and a bottom portion configured between the first portion and the second portion, the gasket adapted to provide an interface between the first and second clamping surfaces and the panel to be secured;

a first control mechanism adapted to apply a first control force in a first force direction to the first clamping member;

a first guide surface adapted to guide movement of the first clamping member in a first guide direction;

a second control mechanism adapted to apply a second control force in a second force direction to the second clamping member;

a second guide surface adapted to guide movement of the second clamping member in a second guide direction;

wherein the first control force causes the first clamping member to move generally in the first guide direction, and the second control force causes the second clamping member to move generally in the second guide direction;

wherein the bottom portion is adapted to compress and/or bend into a lower cavity within the housing upon movement of the first and/or second clamping members.

* * * * *